US005545434A

United States Patent [19]

Huarng

[11] Patent Number: 5,545,434

[45] Date of Patent: Aug. 13, 1996

[54] METHOD OF MAKING IRREGULARLY POROUS CLOTH

[76] Inventor: Hermes Huarng, No. 23, Lane 398, Yiuan-Ping Rd., Chang-Hua City, Taiwan

[21] Appl. No.: 337,486

[22] Filed: Nov. 8, 1994

Related U.S. Application Data

[63] Continuation-in-part of Ser. No. 221,584, Apr. 1, 1994, abandoned.

[51] Int. Cl.[6] ..... B05D 5/06

[52] U.S. Cl. ..... 427/243; 427/273; 427/274; 427/278; 427/280; 427/288; 427/348; 427/359; 427/369; 427/373; 427/389.9; 427/394; 28/165

[58] Field of Search ..... 28/140, 165, 166, 28/167, 168, 169, 163, 106; 427/243, 271, 273, 274, 275, 276, 277, 278, 280, 288, 348, 359, 369, 365, 373, 389.9, 394

[56] References Cited

U.S. PATENT DOCUMENTS

| | | | |
|---|---|---|---|
| 3,908,057 | 9/1975 | Smith, II | 428/151 |
| 4,276,101 | 6/1981 | Lyons | 156/61 |
| 4,618,530 | 10/1986 | Stetson | 428/236 |
| 5,118,557 | 6/1992 | Barnewall | 428/234 |
| 5,158,821 | 10/1992 | Gebauer et al. | 28/156 |
| 5,322,729 | 6/1994 | Heeter et al. | 428/306.6 |

FOREIGN PATENT DOCUMENTS

| | | |
|---|---|---|
| 1560826 | 7/1964 | Germany . |
| 1980443 | 11/1967 | Germany . |
| 2440846 | 3/1976 | Germany . |
| 3114740 | 5/1991 | Japan . |

OTHER PUBLICATIONS

Abstract: JP3114740, May 1991.

*Primary Examiner*—Shrive Beck
*Assistant Examiner*—Erma Cameron
*Attorney, Agent, or Firm*—Browdy & Neimark

[57] ABSTRACT

A method of making an irregularly porous cloth includes a first process in which the woof threads of a cloth are so woven that the meshes of the cloth are irregular in shape. The cloth is then impregnated with a foaming material. The impregnated and foamed cloth is subsequently heated and rolled to form a shading cloth having irregular patterns and pores.

4 Claims, 2 Drawing Sheets

METHOD OF MAKING IRREGULARLY POROUS CLOTH

This is a continuation-in-part of parent application Ser. No. 08/221,584, filed Apr.1, 1994, now abandoned, the contents of which are hereby incorporated by reference.

FIELD OF THE INVENTION

The present invention relates generally to a method of making an irregularly porous cloth, and more particularly to a method of processing a shuttle-woven cloth in a unique manner so that the shuttle-woven cloth can be used for shading or decorating.

BACKGROUND OF THE INVENTION

The shading cloths of the prior art are generally provided with an appropriate permeability to light and are ubiquitously used for a number of purposes. The method of making a conventional shading cloth is illustrated in FIG. 1 in which a fabric material having an appropriate weaving density is dyed and then impregnated with resin or an adhering agent. The dyed and impregnated fabric material is then heated and rolled to take form. The shading cloths made have an appropriate hardness and density and can be cut into pieces for various shading purposes.

The prior art shading cloths described above must be patterned at an additional cost. Furthermore, the prior art shading cloths can be easily faded by the sun and are not always provided with an appropriate permeability.

SUMMARY OF THE INVENTION

It is therefore the primary objective of the present invention to provide a method of making an irregularly porous cloth at a low cost. The porous cloth is patterned and can be used as a curtain, a wall-covering cloth, a shading cloth.

It is another objective of the present invention to provide a method of making an irregularly porous cloth having an appropriate permeability.

The foregoing objectives of the present invention are attained by a method of making an irregularly porous cloth, which includes a first process in which during weaving of a shuttle-woven cloth, the woof threads are so arranged that the meshes or openings of the cloth are irregular in shape. The resultant cloth is then impregnated with a foaming material. The impregnated and foamed cloth is subsequently heated and rolled to form a shading cloth having irregular patterns and pores.

DETAILED DESCRIPTION OF THE INVENTION

Figure 1:
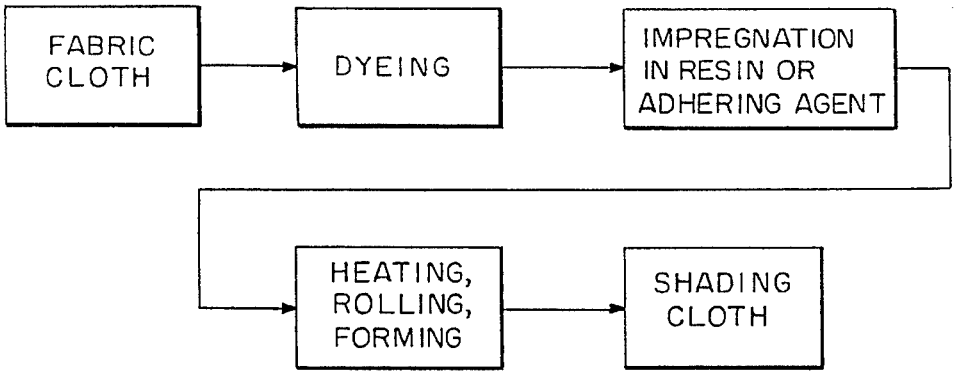
FIG. 1 (PRIOR ART)
FIG. 1 is a flow chart illustrating the prior art method of making a shading cloth.
Figure 2:
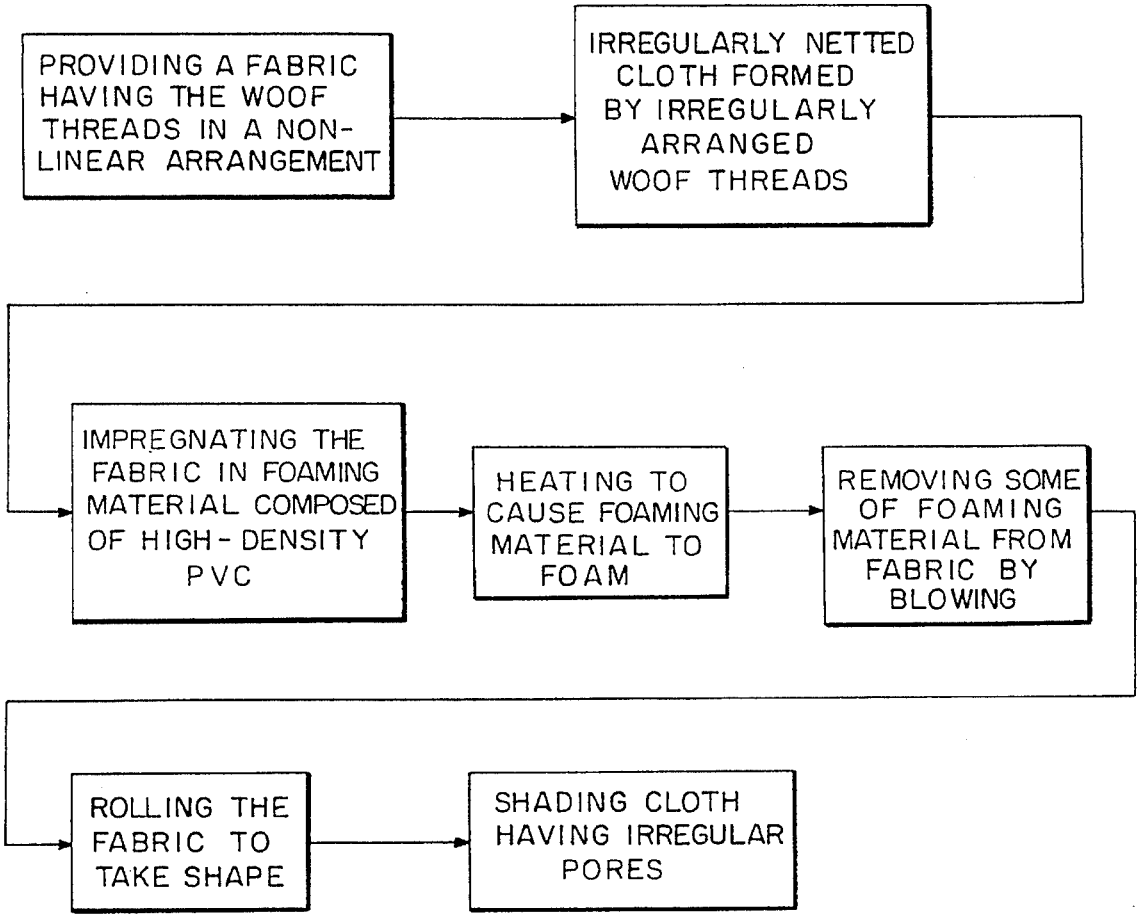
FIG. 2 is a flow chart illustrating a method of making an irregularly porous shading cloth, according to the present invention.
Figure 3:
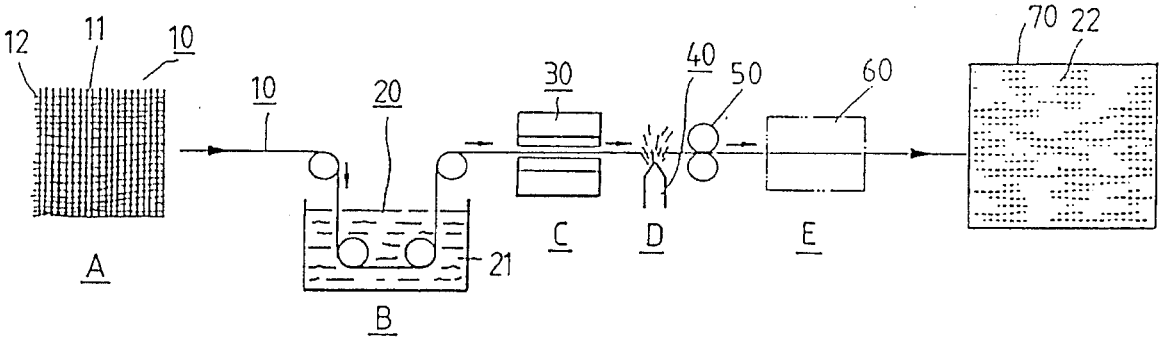
FIG. 3 shows a schematic view of the method of making an irregularly porous shading cloth, according to the present invention.
Figure 4:
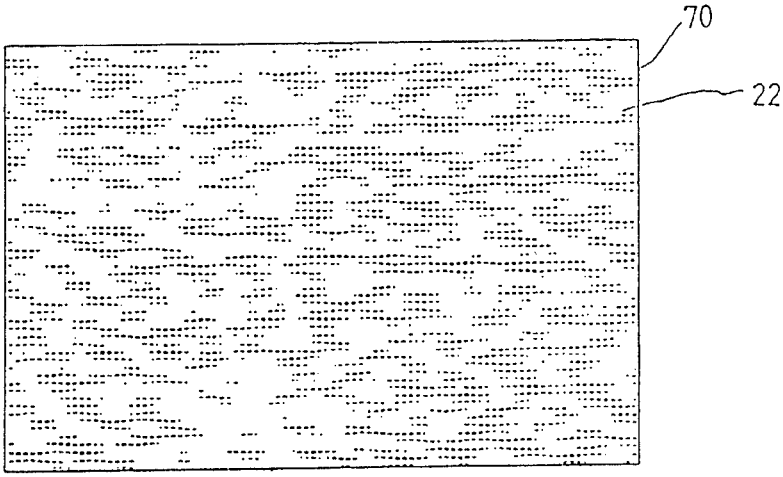
FIG. 4 is a schematic view showing a patterned shading cloth made by the method of the present invention.

Referring to FIGS. 2, 3 and 4, the method of the present invention is shown to comprise the following steps of:

(a) weaving a fabric 10 so that the woof threads 11 of the fabric 10 are arranged in a nonlinear or irregular manner, the fabric having openings of different sizes and shapes between adjacent woof threads;

(b) impregnating the so woven irregular fabric 10 in a liquid tank 21 containing a foaming material 20 which is composed of a polyvinyl chloride resin, i.e. PVC;

(c) heating by means of a heater 30 the impregnated fabric 10 to cause the foaming material 20, which is adhered to the surface of the irregular fabric 10, to foam;

(d) removing some of the PVC foaming material 20 from the surface of the fabric 10 by pressurized air emitted from a nozzle 40 so as to form a number of irregular pores of varying and irregular size between the warp threads 12 and the irregular woof threads 11; and (e) pressing the fabric 10 with a roller 50 and subsequently subjecting the rolled fabric 10 to a shaping process 60 in which a cloth 70 is formed, with the cloth 70 having a number of irregular pores and irregular patterns formed by the foam material 22 thereby providing an irregularly porous fabric.

As can be seen from FIG. 4, the final cloth product 70 has areas in which the initial openings are completely filled with PVC foam, i.e the cloth 70 is non-porous in these areas, and other areas where the PVC foam does not completely fill the initial openings so as to leave pores of varying size and shape, i.e. irregular pores. In general, the larger initial openings are less likely to become filled with PVC foam in the final cloth product 70 so as to leave the irregular pores, whereas the smaller initial openings are more likely to become completely filled with PVC foam so as to create the non-porous areas.

The method of the present invention is different from the prior art method in that the woof threads of the present invention are arranged irregularly and nonlinearly to create a number of irregular meshes, and that the patterns of the shading cloth are formed by the residue of the foaming material in the pressing and forming process. For example, a decorative pattern may be formed during the final pressing and forming, after the rolling and before the PVC is fully solidified.

In addition, the method of the present invention is characterized in that the patterns are formed on the cloth directly without any additional printing work, and that the woof threads are not limited in number, and further that the twisting of the threads is dependent on the kind of fiber and the use of the product. Moreover, the selection of the warp threads and the woof threads of the present invention depends on the intended use of the final product. For example, if the irregularly porous cloth 70 of the present invention is intended for use in making a sunshade or curtain, synthetic fibers, such as polyester (e.g. Dacron), polypropylene compound yarn, nylon, etc., may be used as raw materials. If the irregularly porous cloth of the present invention is intended to be used in making a decorating material, such as a table cloth, a glove, a shoe surface, etc., rougher fiber materials, such as a polyester/cotton blend, a polyester/rayon blend, hemp and the like, may be used as raw materials.

The advantages inherent in the present invention are readily apparent and described explicitly hereinafter.

The cost of making an irregularly porous cloth by the method of the present invention is lower than that of making a shuttle-woven cloth.

According to the present invention, no additional cost and process are involved in having the cloth patterned.

The light and air permeability of the cloth can be appropriately controlled by the air blowing process of the method of the present invention.

Shading cloth made by the method of the present invention is relatively light in weight and can be used indoors or outdoors. The cloth made by the method of the present invention is relatively durable and can be used in place of wall paper.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of making an irregularly porous cloth comprising the steps of:

(a) providing an irregular fabric having warp threads and woof threads, with said woof threads being arranged in a nonlinear manner with openings of different size between adjacent woof threads;

(b) impregnating said fabric with a foaming material;

(c) heating said impregnated fabric to cause said foaming material to foam;

(d) removing a portion of said foaming material from the surface of said impregnated and heated fabric by pressurized air emitted from a nozzle so as to form a number of irregular pores of varying size between said warp threads and said woof threads; and (e) pressing said fabric, obtained in said step of removing a portion of said foaming material, with a roller, whereby a residue of said foaming material forms an irregular pattern on said fabric.

2. The method of claim 1 wherein said foaming material is composed of polyvinyl chloride and a foaming agent.

3. A method of making a plastic impregnated cloth containing areas with pores of irregular size and shape, and non-porous areas, comprising:

weaving an irregular fabric with woof threads arranged in a nonlinear manner so as to provide openings of different sizes and shapes between adjacent woof threads;

impregnating said fabric with a plastic material containing a foaming agent;

heating said impregnated fabric to cause said plastic material to foam;

applying pressurized air to said fabric to remove a portion of said plastic material and thereby forming areas of irregular pores of varying size between said woof threads; and pressing said impregnated fabric and solidifying said plastic foam.

4. A method according to claim 3 wherein said impregnating is carried out in a liquid tank and said pressing is carried out with a roller.

* * * * *